US007180426B2

(12) United States Patent
Rubtsov

(10) Patent No.: US 7,180,426 B2
(45) Date of Patent: Feb. 20, 2007

(54) INCAPACITATING FLASHING LIGHT APPARATUS AND METHOD

(75) Inventor: Vladimir Rubtsov, Los Angeles, CA (US)

(73) Assignee: Optech Ventures, LLC, Torrance, CA (US)

( * ) Notice: Subject to any disclaimer, the term of this patent is extended or adjusted under 35 U.S.C. 154(b) by 158 days.

(21) Appl. No.: 10/993,698

(22) Filed: Nov. 19, 2004

(65) Prior Publication Data

US 2006/0119483 A1 Jun. 8, 2006

(51) Int. Cl.
*G08B 5/00* (2006.01)

(52) U.S. Cl. ..... 340/815.4; 340/321; 340/573.1; 340/574; 340/815.75; 42/1.08; 361/232; 362/259

(58) Field of Classification Search ..... 340/815.4, 340/815.43, 815.49, 815.69, 815.75, 321, 340/573.1, 574, 691.7, 693.5; 116/7, 202; 362/259; 361/232; 222/39; 42/1.08
See application file for complete search history.

(56) References Cited

U.S. PATENT DOCUMENTS 5,556,003 A * 9/1996 Johnson et al. ..... 222/39
5,644,297 A * 7/1997 Masi et al. ..... 340/573.1
5,949,338 A * 9/1999 Masi et al. ..... 340/573.1
6,144,302 A * 11/2000 Cotty et al. ..... 340/573.1
6,791,816 B2 * 9/2004 Stethem ..... 361/232
6,898,887 B1 * 5/2005 Stratbucker ..... 42/1.08

OTHER PUBLICATIONS

American National Standards Institute, American National Standard for Safe Use of Lasers, ANSI 2136.1-2000, 1993, USA.
Richard Dennis, James Harrison, Visual Effects of the Green Laser-Baton Illuminator (GLBI), May 2001, U.S. Air Force Research Laboratory, Texas, USA.
Leon N. McLin et al., The Laser Threat, U.S. Air Force (USAFSM), Colorado, USA.
Visual Impairment Brain Waves Paper.
Sidney S. Charschan, Evolution of Laser Safety Standards ANSI 2136.1s, Journal of Laser Applications, Dec. 1998, vol. 10, Issue 6, USA.
Vladimir Rubstov, High Intensity Laser with Fiber Optic Multidirectional Strobe, Intelligent Optical Systems.

* cited by examiner

*Primary Examiner*—Davetta W. Goins
(74) *Attorney, Agent, or Firm*—Lawrence S. Cohen

(57) ABSTRACT

Apparatus and method for using an light source to incapacitate a subject in which the light source strobes by a spatial scanning through a pattern and a temporal flashing at a rate sufficient to cause incapacitation. The strobing (meaning both spatial scanning and temporal flashing is in a pattern to prevent the subject from escaping the strobing effect. The flashing is timed so that each flash point in the pattern will flash at a rate and sequence to cause incapacitation. In a preferred embodiment, the light source is an array of LEDs or laser diodes.

36 Claims, 6 Drawing Sheets

170

INCAPACITATING FLASHING LIGHT APPARATUS AND METHOD

FIELD OF THE INVENTION

The invention relates to devices for using flashing light to incapacitate a person or other animal.

BACKGROUND

Security devices using light are known.

In U.S. Pat. No. 6,007,218 a laser based security device is shown that uses visual laser light at predetermined wavelengths and intensities to create temporary visual impairment to cause hesitation, delay, distraction and reductions in combat and functional effectiveness.

In U.S. Pat. No. 6,190,022 a visual security device is shown that uses sequentially flashing multiple LEDs.

The references listed herein also provide background.

SUMMARY

In one aspect the invention is a device for incapacitating a subject using a source of a beam of light by strobing (as defined herein).

In one aspect the invention is a device for incapacitating a subject using an array of light emitting elements by strobing (as defined herein).

In another aspect the invention is such an incapacitating device in which the light emitting elements are an array of LEDs.

DESCRIPTION

Figure 1:
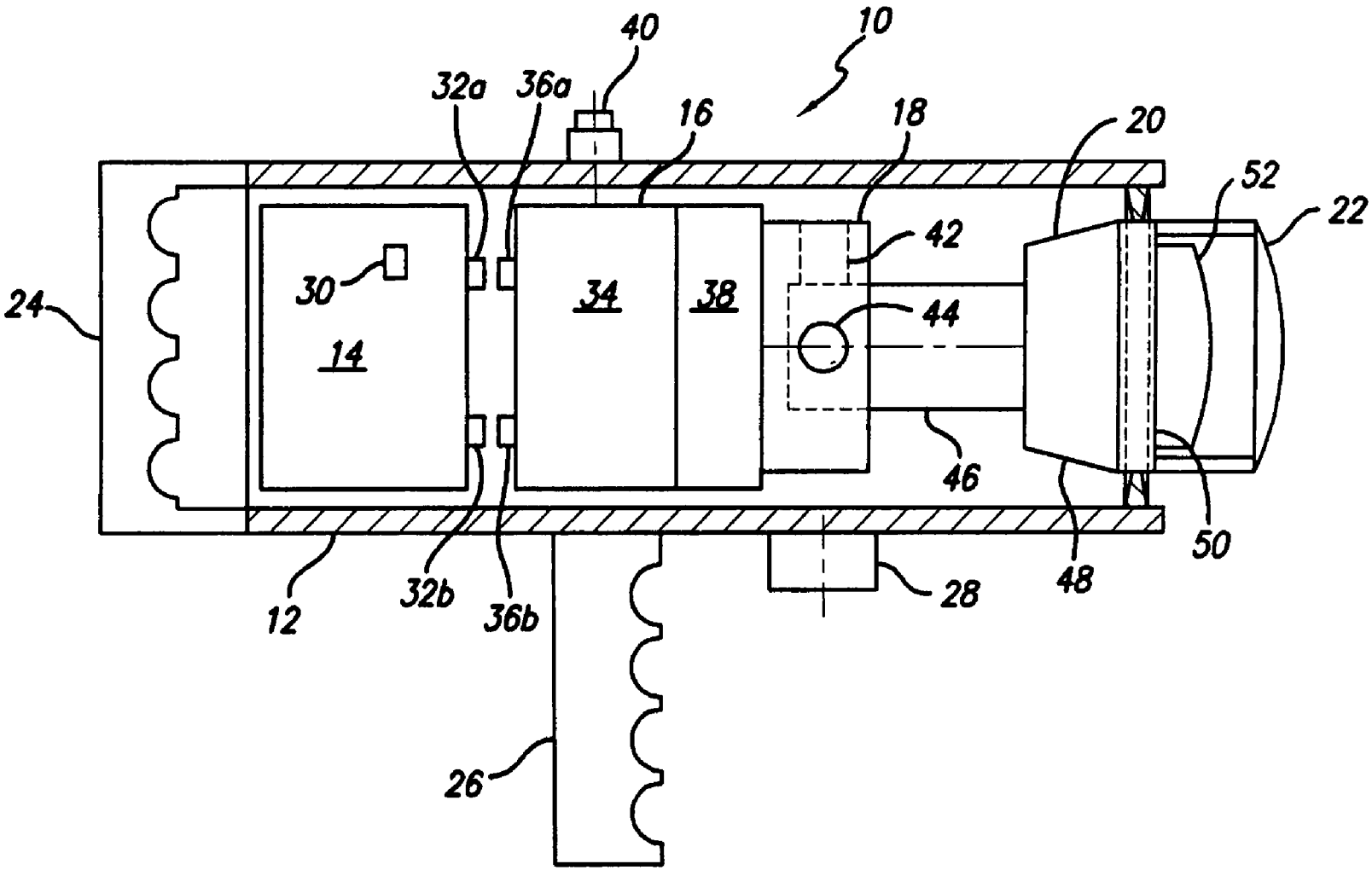
FIG. 1 is a schematic view of an exemplary embodiment of the invention.

Following is a description of the invention sufficient to enable it to be practiced and extending to the best mode or modes of the invention known to the inventor.

In one aspect the invention is a method and apparatus for incapacitating a person or other animal (referred to as the subject or target) by causing a light source to have a temporal flash component and a spatial scan component. The spatial scan component will create a pattern by means of positions in the apparatus that result in flash points in space to define a scanned area. In one aspect the invention is a method and apparatus for incapacitating a person or other animal by use of an array of light emitting elements having a temporal flash component and a spatial scan component in a repeating pattern such that at each repetition of a given position in the pattern a flash rate occurs within the range of flash rates that will cause some level of incapacitation. When a plurality if light emitting elements is used each may be equipped with a collimator, or a combined beam former may be used to transform the wide angle of the LEDs to a narrow beam. The exposure of the subject to the flashing light is not necessarily limited to avoiding permanent injury or lethality. However, in one aspect the invention is defined in relation to the MPE (maximum permissible exposure) as defined in Laser Institute of America ANSI Z136.1-2000, Safe Use Of Lasers (reference 1) so as to not exceed the MPE.

In one aspect of the invention the spatial scan rate and the temporal flash rate are selected such that in each cycle of the pattern at least one flash occurs at each flash point.

In accordance with the invention, it is important that light energy be delivered to a target area that includes an area greater than the beam footprint. This prevents the subject from escaping the effect of the flashing. This is done by setting the device to a sequence of directions to visit a sequence of flash points to result in a pattern that defines an area in space. In such a case, it is necessary to spatially scan the beam through a sequence of positions while flashing to ensure the delivery of the energy to effect some level of incapacitation. The direction of the beam and the number of flashes to occur in each position may be achieved in a number of different ways. Two examples are presented. The first involves a flash rate that is so much faster than the spatial scan rate that the beam direction revisits each position in the scan sequence and consequently each flash point in space at a rate such that at least one flash occurs at each flash point. The second is that the spatial scan rate is so much greater than the flash rate that not every flash point is flashed at each spatial scan cycle.

These conditions are controlled by three variables:

A=scan rate, the time for spatial scan of the entire pattern in cycles/unit time;

B=flash rate, the time in flashes/unit time; and

C=number of positions or flash points in the pattern;

whereby the relationship that defines the sequence of temporal flashing and spatial scanning within the pattern is given by:

$$\text{number of flashpoints per flash} = \frac{A \times C}{B}$$

wherein flashes may occur once or a multiple of times at each flash point per spatial scan cycle, or may skip one or more flash points per spatial scan cycle.

The term strobe or strobing is be used in this description and in the claims as having a special definition, meaning a combination of a spatial scan component being the movement of the beam and of a temporal flash component representing the flashing of the light emitting elements. Strobing is utilized to create a flash pattern also called a target configuration. A flash pattern is established by the spatial scan component to provide a set of flash points in space each flash point representing one direction of the beam footprint. Typically the flash points are illuminated in a flash order which in one embodiment is repeated to define the flash pattern. A flash is defined as being repeated in an ordered sequence when there is some geometric relationship to the sequence such as adjacent flash points. One or both components of the strobe or strobing, the spatial and the temporal, can be set fixedly or be adjustable. When all the flash points of a flash pattern have been visited, either with one or more flashes or not, a flash pattern cycle is completed.

Also, as will be explained in more detail below, the flash order may be set to a regular geometric relationship such as with the flash pattern spatially scanning through adjacent flash points, or it may be set in a randomized flash order that repeats itself in each cycle. Although it is practical to cause the flash order to repeat by use of a CPU controlled and programmed device the flash order can vary for each cycle.

In one embodiment each flash point is flashed at least once in each spatial scan cycle. Although this may be done in an ordered sequence as described above, it may also be done in a randomized sequence. In either case the sequence may be constantly repeated or may be varied such as by different ordered sequences or by different randomized sequences. For example, a set of X different randomized flash patterns can be programmed, which repeat.

In another aspect the target of exposure is exposed to an amount of irradiance not exceeding the MPE (as designated in ANSI Z136.1-2000) in order to cause less than permanent injury to the eyes.

These and other aspects of the invention will be apparent from the following description(s) of embodiments of the invention.

FIG. 1 shows in schematic form, an apparatus 10 constructed in accordance with the invention. The apparatus 10 has a case 12 in which are contained the operating components. These are a power supply 14, an electrical control module 16, a scan module 18, a light emitting module 20 and a lens or beam former 22.

The case 12 can be generally elongated to carry the components, although any workable arrangement of the components and configuration of the case 12 is within the scope of the broad concept of the invention. It has a rear handle 24 and a lower handle 26 adapted to enable it to be held and operated by hand. Also it has a mounting receptacle 28 for attaching any kind of stand for holding it in a steady and controllable position. Although the flash pattern is designed to trap a subject in the pattern, that is to be large enough that incapacitation will occur before the subject can escape from the pattern; it is also possible that the user can traverse the apparatus as the subject moves in order to keep the subject closer to the middle of the scan pattern and in any event to keep the subject in the pattern as long as necessary.

The power supply 14 can be a rechargeable battery along with or alternatively, a receptacle for an external power source. A battery life indicator 30 is shown as well as contacts 32*a* and 32*b*.

The electrical control module 16 has an electrical input and control element 34 connected to the power supply 14 by contacts 36*a* and 36*b* and a spatial scan control element 38 that has circuitry and processing elements for allowing the spatial scan and temporal flash to be set and controlled. An adjusting mechanism 40 allows the spatial scan rate and temporal flash rate to be changed.

In one embodiment the spatial scan module 18 has a vertical scanner mechanism 42 and a horizontal scanner mechanism 44. In one embodiment the vertical scanner 42 is a linear actuator or incrementer that will operate in specific, and if desired, adjustable vertical increments while the horizontal scanner 44 is a continuous reciprocating scan device operating over a horizontal reciprocal range and if desired it can have an adjustable (in either or both speed and range) mode. These could be reversed. Where a continuous motion of scanning is used the flash points are defined by the event of flashing; and where a stepping device is used the flash points may be defined by a mechanical position.

The light emitting module 20 has a control frame 46 extending from the scan module 18 to an light element support frame 48 on which are mounted a heat sink 50 and a light source 52.

Figure 2:
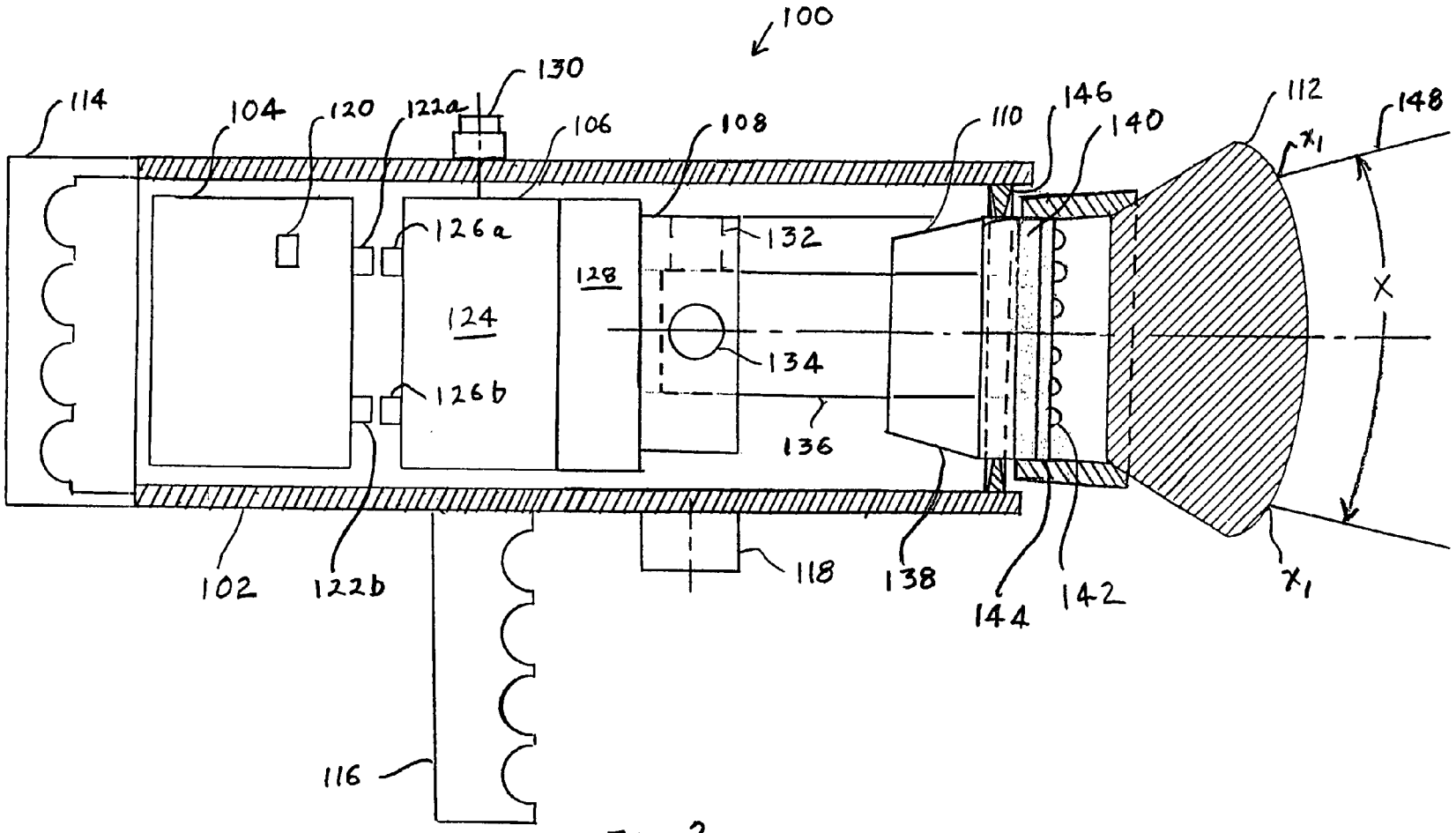
FIG. 2 is a schematic view of an exemplary embodiment of the invention.

FIG. 2 shows in schematic form, an alternative apparatus 100 constructed in accordance with the invention. The apparatus 100 has a case 102 in which are contained the operating components. These are a power supply 104, an electrical control module 106, a scan module 108, a light emitting module 110 and a lens or beam former 112.

The case 102 can be generally elongated to carry the components, although any workable arrangement of the components and configuration of the case 102 is within the scope of the broad concept of the invention. It has a rear handle 114 and a lower handle 116 adapted to enable it to be held and operated by hand. Also it has a mounting receptacle 118 for attaching any kind of stand for holding it in a steady and controllable position. Although the flash pattern is designed to trap a subject in the pattern, that is to be large enough that incapacitation will occur before the subject can escape from the pattern; it is also possible that the user can traverse the apparatus as the subject moves in order to keep the subject closer to the middle of the scan pattern and in any event to keep the subject in the pattern as long as necessary.

The power supply 104 can be a rechargeable battery along with or alternatively, a receptacle for an external power source. A battery life indicator 120 is shown as well as contacts 122*a* and 122*b*.

The electrical control module 106 has an electrical input and control element 124 connected to the power supply 104 by contacts 126*a* and 126*b* and a spatial scan control element 128 that has circuitry and processing elements for allowing the spatial scan and temporal flash to be set and controlled. An adjusting mechanism 130 allows the spatial scan rate and temporal flash rate to be changed.

In one embodiment the spatial scan module 108 has a vertical scanner mechanism 132 and a horizontal scanner mechanism 134. In one embodiment the vertical scanner 132 is a linear actuator or incrementer that will operate in specific, and if desired, adjustable, vertical increments while the horizontal scanner 134 is a continuous reciprocating scan device operating over a horizontal reciprocal range and if desired it can have an adjustable (in either or both speed and range) mode. These could be reversed. Where a continuous motion of scanning is used the flash points are determined by the event of flashing; and where a stepping device is used the flash points may be determined by a mechanical position.

The light emitting module 110 has a control frame 136 extending from the scan module 108 to an light element support frame 138 on which are mounted a heat sink 140 and an array of LEDs (light emitting diodes) 142 on a mounting platen 144. The light emitting module 110 is held in place by a flexible support ring 146 that allows the light emitting module 110 to pivot as it is moved in the spatial scan component of the strobe function.

The LED array 142 can be an array of discrete LEDs or it can be one or more LED clusters.

The beam former 112 is an optical element that functions to form a desired beam 148 from the light emitted by the LED array 142. The beam angle X defines the size of the spot of a single flash point on the target. The beam diameter at the exit of the beam former defines the observed aperture $x_1$—$x_1$. Other light emitting elements can be employed. For use of coherent light sources, a laser source can be employed with optical fibers carrying the laser light from a single laser at an input end to an output end the output ends being arranged in an array. Alternatively a plurality of lasers in an array could be employed. By use of coherent light, with less divergence, longer operating ranges are possible.

Other light emitting elements include laser diodes used in the same manner as the LEDs, in which case a beam combiner or/and a beam expender could be used.

The beam can be formed in other ways. In one aspect each light emitting element can have its own beam former. In the case of LEDs each one can have its own collimator.

Scanning can be accomplished by other than the mechanical means shown above. An electro-optical scanning element such as an electro-optical crystal lens such as a lithium niobate crystal can be placed in front of the beam former or formers. An opto-mechanical scanner such as cylindrical cartridge containing a number of optical fibers equal to the number of flash points could be employed. The fibers are organized at the output in such a manner that light flashes from the end of the fibers cover the predefined area during axial rotation of the cartridge. Also liquid crystals can be used for scanning.

Figure 3A:
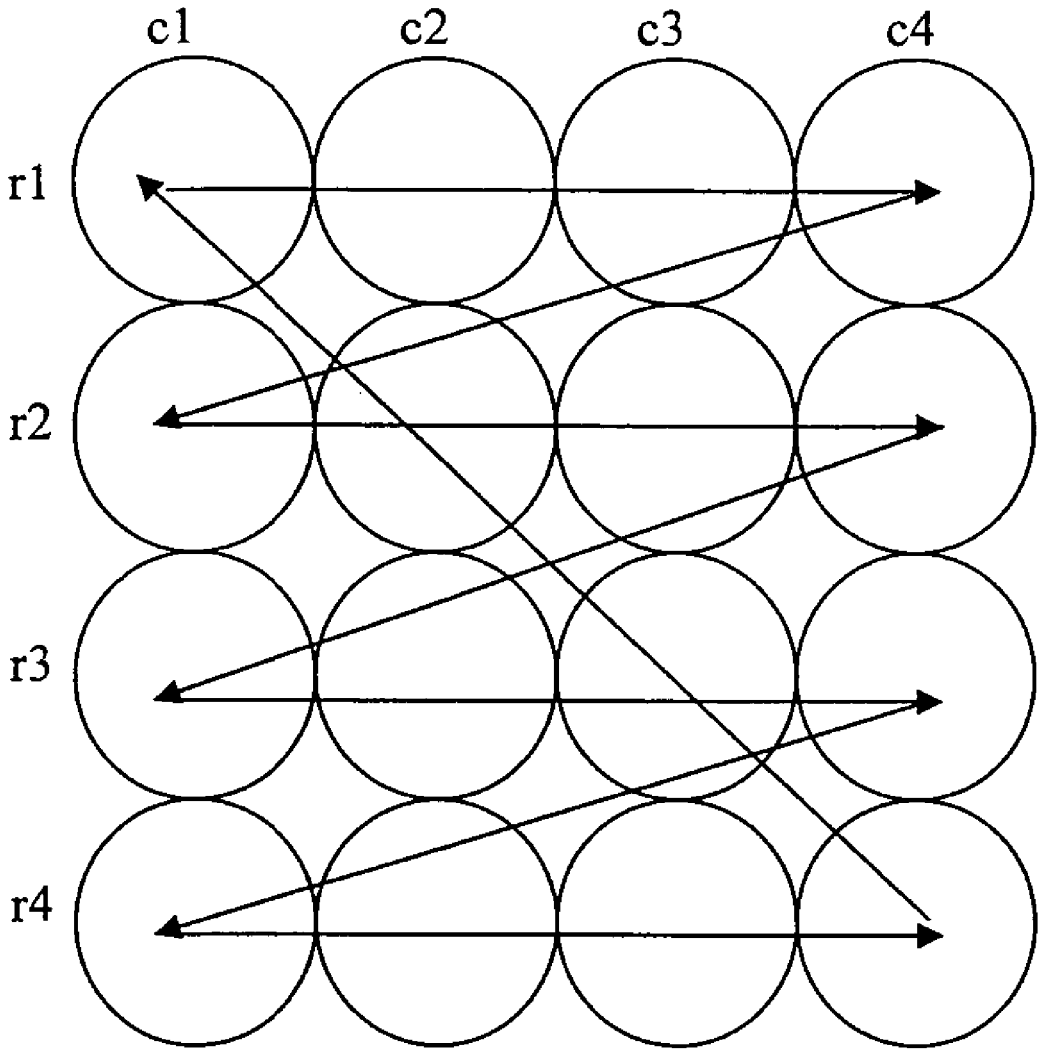
FIG. 3*a* is a drawing of an exemplary flash pattern.
Figure 3B:
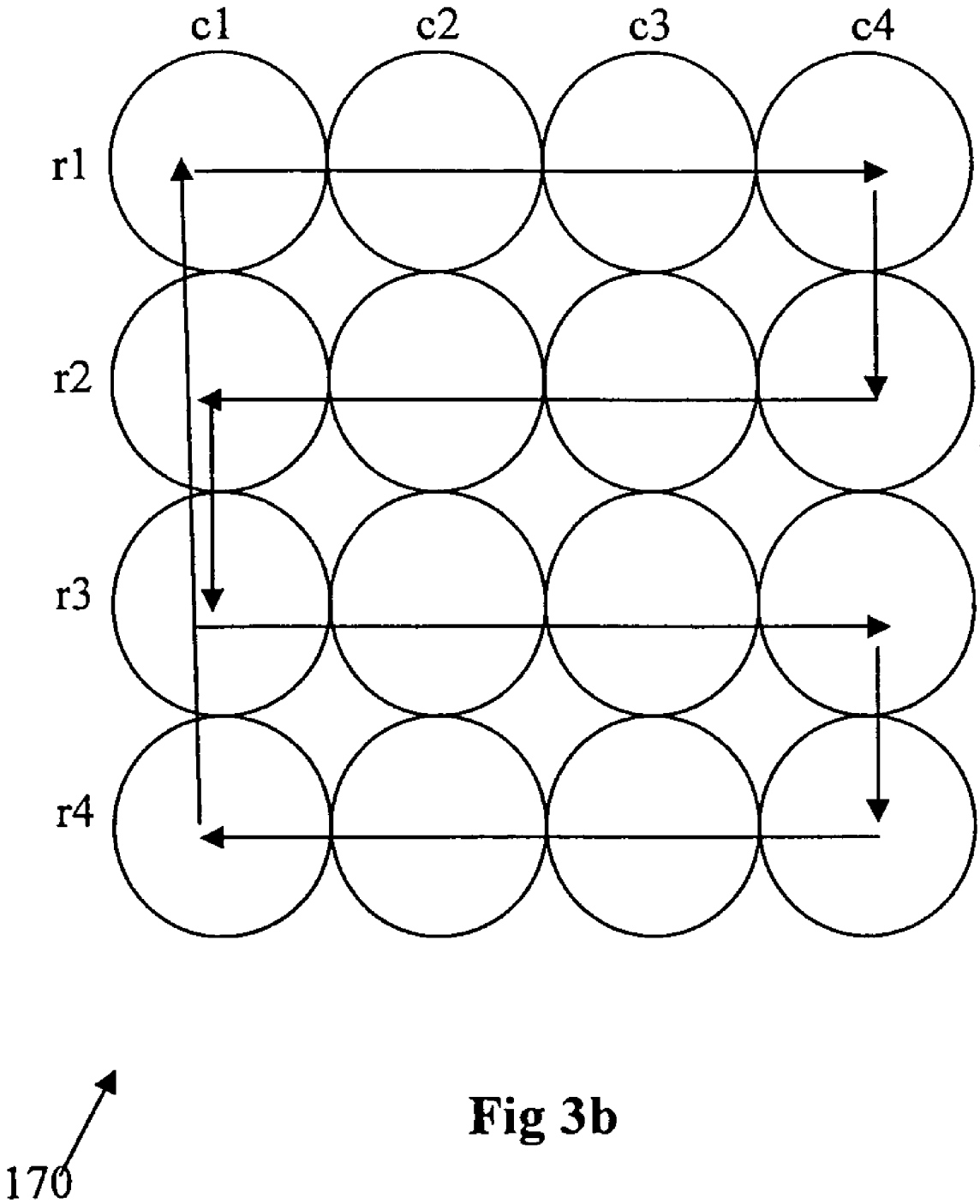
FIG. 3*b* is a drawing of another exemplary flash pattern.

FIGS. 3*a* and 3*b* show an exemplary target configuration 170, in this example made up of four rows r1, r2, r3, and r4 and four columns c1, c2, c3, and c4 representing flash exposure points for each flash of the LEDs as they are scanned and incremented.

Figure 4A:
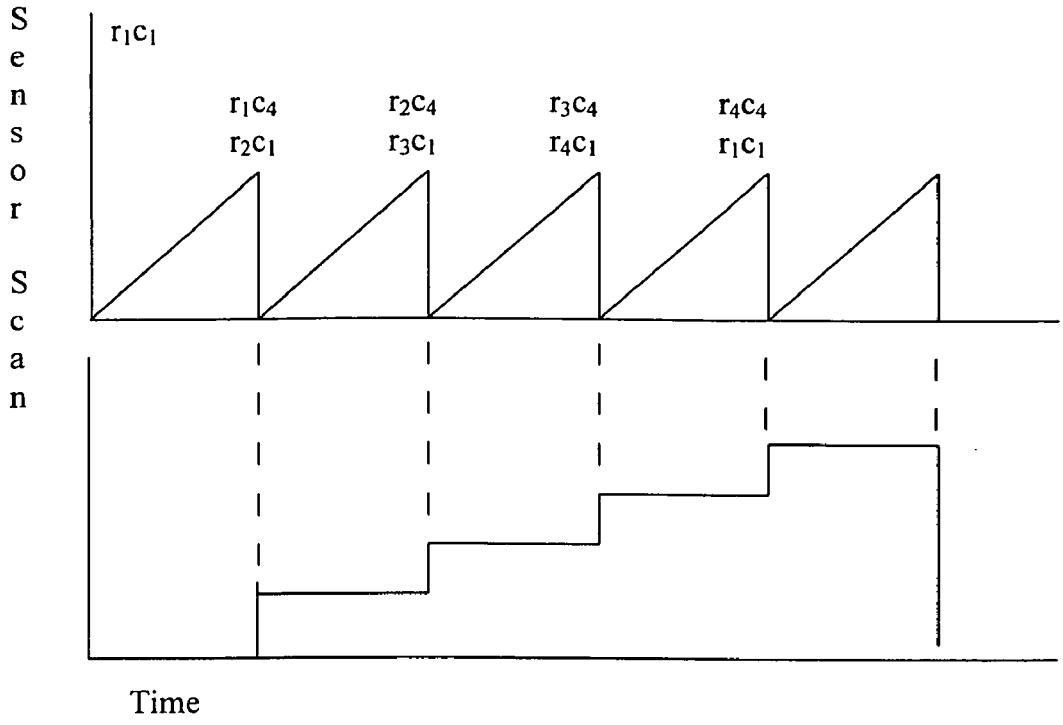
FIG. 4*a* is a time graph for the sequencing of scanning and flashing for the flash pattern of FIG. 3*a*.

In FIG. 3*a* the target configuration 170 is a flash pattern having 16 flash points in a 4 by 4 matrix or pattern that operates through a strobing sequence as illustrated in FIG. 2*a* in which the spatial component starts at the flash point r1, c1 and moves horizontally to r1, c4 and then is both incremented vertically down and reversed horizontally to r2, c1 and then strobes through r2, c4 and so on. After the flash at r4, c4 the scanner and incrementer return to flash at r1, c1 and the sequence is repeated. The chart for that sequence is shown in FIG. 4*a*.

Figure 4B:
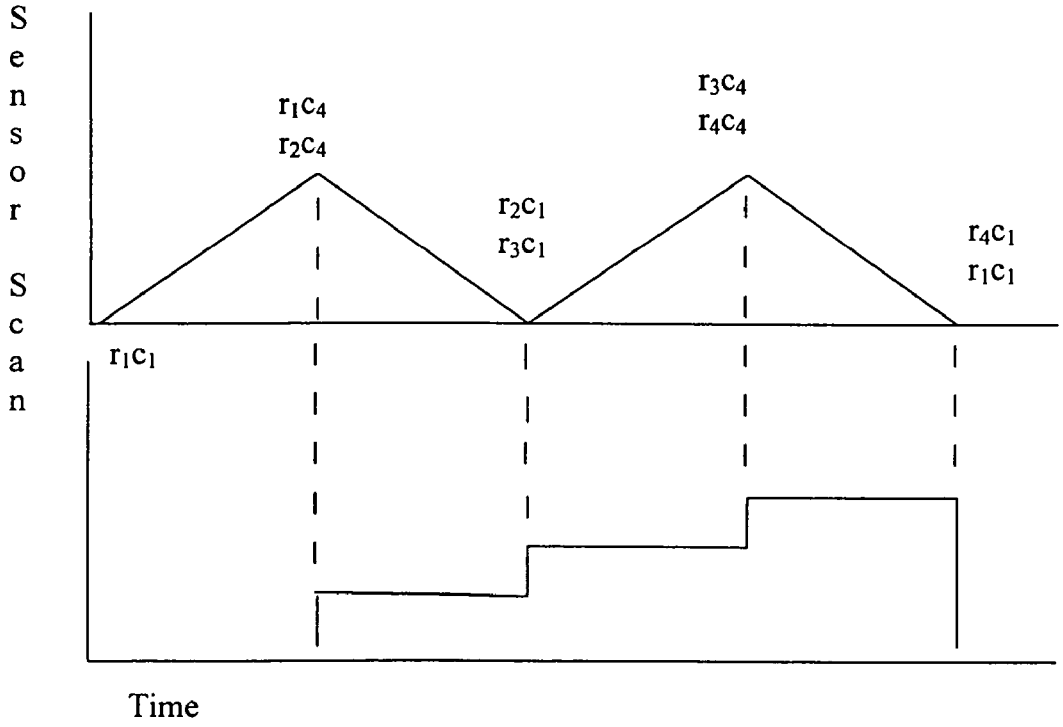
FIG. 4*b* is a time graph for the sequencing of scanning and flashing for the flash pattern of FIG. 3*b*

In FIG. 3*b* there is shown the same 4 by 4 pattern with an alternative strobe sequence in which the spatial component differs starting at the flash point r1, c1 and scanning horizontally to the right to r1, c4 and then incrementing vertically to r2, c4 and then scanning horizontally to the left to r2, c1 then incrementing vertically to r3, c1, then scanning horizontally to the right to r3, c4, then incrementing vertically to r4,c4 and then scanning horizontally to the left to r4, c1 and then incrementing upward to r1, c1 to begin the sequence again. The chart for that sequence is shown in FIG. 4*b*.

In each of the examples of FIGS. 3*a* and 3*b*, the sequence could be rotated ninety degrees so that scanning occurs vertically and incrementing occurs horizontally.

The foregoing described sequences through adjacent flash points. But the sequence could be randomized to a selected repeating order of flashes. The flash order should repeat after each cycle. Moreover, through programming options, the user can be enabled to select a pattern through adjacent flash points or randomized repeating or even randomized varying (in which the cycle is completed but differently each time).

The pattern and strobe sequence is selected for the particular application. It need not be equal horizontally and vertically, for example a pattern of six columns and four rows might be selected. Also, for example, a pattern might have a center flash point surrounded by three or more flash points and then possibly surrounded by several more. An arrangement of concentric circles with or without a central flash point might be useful. The purpose of the pattern is to cover an area such that a subject or subjects exposed to the strobing will be unable to move or at least will have difficulty moving out of the pattern before being incapacitated.

The flash pattern is cycled over a time period to repeat each flash point at a rate sufficient to incapacitate a subject who is in the pattern. It is known that flash rates from 7–15 Hz can achieve incapacitating effects. A preferred range of flash rate for incapacitating effect is 9–11 Hz. Therefore the strobe rate is selected to cause each flash point to flash at the selected rate.

It is not necessary that a specific flash point be directly aimed at the subject's eyes, but at least some of the flash points should be so closely directed to the subject's eyes as to have the flash effect. Thus the flash pattern will be designed in accordance with the type of use contemplated. Also a given device could be equipped to allow selection of different flash patterns for different uses.

In one exemplary use, for personal protection, a pattern effective at a range of, say, 1–5 meters would be desirable. For law enforcement purposes a pattern effective at a range from 5–10 meters would be desirable. For combat purposes a longer range would be desirable. In each case the parameters of flash rate and irradiance coupled with observed aperture, beam angle and radiant aperture must be selected to enable incapacitation.

In some embodiments and applications it is desired or required that incapacitation effects be obtained but without injury to the subject's eyes. If incapacitation without injury (to the eyes) is desired the irradiance level must not exceed the MPE.

In another aspect the invention is a method and apparatus in which an array of light emitting elements or a single element will cause incapacitation by applying a selected flash rate, pulse duration and, for each flash, an optical power such that at a particular range an irradiance level will be provided at a particular range. In a further aspect, the irradiance is a minimum of 1/260 of the MPE. Also, the range may be selected to not exceed the MPE.

All the work and calculations that resulted in the data presented in Table 1 was carried out under the guidance of the safety standards developed by the Laser Institute of America ANSI Z136.1-2000, Safe Use of Lasers [Ref 1]. This document provided a number of rules that should be followed for the safe use of high intensity light sources in particular, it contained diagrams and formulas to define the maximum permissible exposure (MPE), which provided the relationship between intensity of the exposure, and the eye-damage threshold. Data from different types of point and extended radiation sources, operating in continuous and pulsed modes, is presented.

The focused LED modules and arrays are considered an extended source of radiance. Such radiation source is defined as a source viewed by the observer at an angle larger than $\alpha_{min}$, which is 1.5 mrad. The formula for calculating $MPE_{pulses}$ in terms of source energy level for extended light sources is given in Ref. [6], p. 46, Table 5b and Section 8.2.3. on page 37:

$$MPE_{pulses} = 1.8 \times C_E \times n^{-0.25} \times \tau^{0.75} \frac{mJ}{cm^2} \quad (1)$$

where $\tau$ is the pulse duration or exposure time, n is the number of pulses in the train, and $C_E = \alpha/\alpha_{min}$ when $\alpha_{min} \leqq \alpha \leqq \alpha_{max}$, and where $\alpha_{max}$ is 100 mrad. $\alpha$ is aperture of the device observed at the target plane. The LED results in Table 1 fall in this interval.

In terms of irradiance, for average pulse power, MPE:

$$E_{pulses} = MPE_{pulse}\frac{F}{d},$$

where F is the frequency, and d is the pulse duty cycle. Since only part of the energy reaches the human retina through the iris in the eye (approximately 7 mm in diameter), the $MPE_{pulses}$ must be reduced by a factor of 0.775. The final formula is:

$$MPE: E_{pulses} = \frac{1.8 \times \tau^{0.75} \times C_E \times n^{-0.25} \times F}{0.775 \times d}\frac{\text{mW}}{\text{cm}^2} \quad (2)$$

It is well recognized that bright light flashing at frequencies near the frequencies of the human brain (7–15 Hz) and operating in the eye-safe region, are capable of affecting a person, or a group of people, through visual impairment (green and blue-green light are especially effective). The physiological and psychological effects of these types of light are rapidly induced and can range from simple glare and flashblindness to strong startlement, vertigo and disorientation. The strongest effects appear when the source intensity is at the level of the MPE (but still in the safe region), and the effectiveness of the visual impairment drops with the reduction of the intensity of light. An attempt to classify the visual impairment effect in accordance to the intensity of light for one exposure of 0.25 sec that is equal to the aversion time (blink effect) has been made in Reference [2]. The diagram of FIG. 4 presented below progressively shows the effects from very strong flashblindness (which includes vertigo, disorientation and startlement) to simple glare (right column) versus irradiance level on the eye (left column). The strongest effects appeared when the irradiance is on the level of MPE, which is 2.6 mW/cm$^2$. The arrow on the right pointing down indicates the decrease of the effectiveness, as the exposure time diminishes.

At frequencies of 7–15 Hz, exposure duration of 0.25 sec is not achievable. Therefore, a number of pulses should be applied to accomplish incapacitating effect. As shown in Formula (2), MPE and hence, the strongest effect, could be provided at any level of irradiance by applying the respective number of pulses, while maintaining the equivalence of the other parameters. There would be more pulses at lower irradiance and vice versa. In turn, the number of pulses will define the incapacitating time. To estimate this time, the formula is rewritten as:

$$n = \left(\frac{1.8 \times \tau^{0.75} \times C_E \times F}{0.775 \times d} \times \frac{1}{MPE: E_{pulses}}\right)^4 \quad (3)$$

and the irradiance that was accomplished in the device is suggested as the MPE. The number of pulses derived from (3) gives the estimated time necessary to produce the highest level of the incapacitating effect at a given irradiance, frequency, pulse duration and the device design ($C_E$).

The visual impairment that is produced by the intense flashing light is a cumulative effect; therefore, the dosage of radiation received depends on the number of pulses delivered. Alternatively, in another way, as fewer pulses are delivered, the MPE would be higher (see Formula 1). Hence, if one wants to estimate the time necessary to produce visual impairment effect at the level of irradiance lower than MPE, the number of pulses in Formula 1 should be simply divided by the ratio of irradiance produced by the device (which is considered as MPE) by the irradiance, at which level the effect is considered:

$$n_I = \frac{n_{MPE}}{A}, \quad (4)$$

where $$A = \frac{I_{MPE}}{I}$$

($I_{MPE}$ is the irradiation produce by the devise, and I is the level of irradiance under consideration).

By substituting n in (1) for (4), the final formula (3) is rewritten as $$n = \left(\frac{1.8 \times \tau^{0.75} \times C_E \times F}{0.775 \times d} \times \frac{1}{A \times MPE: E_{pulses}}\right)^4 \quad (5)$$

For exemplary considerations, this formula was used to calculate the time durations necessary to produce visual impairment effects at levels equivalent to the single irradiance exposure levels of 2.6, 1, 0.5, 0.1 and 0.01 mW/cm$^2$ for a given frequency of pulses. The value of A is 1, 2.6, 5.2, 26 and 260, respectively. These were selected for providing degrees of incapacitation (A, B, C, D and E in Table 1).

Equation (5) establishes the relationship between the irradiance on the target and the flash time, number of flashes and the observed clear aperture of the device.

The results are presented in Table 1.

TABLE 1

Calculation of Times to Produce Various Levels of Impairment with LED-Based Devices

| | LED array parameters | | | |
|---|---|---|---|---|
| | I. Tested 19LED module: α = 25°, Aperture at exit-4.6" Average radiant | II. Tested 37LED module α = 25°, Aperture at exit 6" Average radiant | III. Considered 37LED DESIGN1: α = 5° Aperture at exit-6" | IV. Considered 37LED DESIGN2: α = 10° Aperture at exit 4" |

| Effects produced | Equivalent to irradiance levels shown in FIG. 1–4 | power 1.15 W, Irradiance-4.9 mW/cm$^2$ (Actual) Area of coverage-2.66 feet of the diameter | power 2.5 W, Irradiance-9.1 mW/cm$^2$ (Actual) Area of coverage-2.66 feet of the diameter | Average radiant power 2.5 W, Irradiance-233 mW/cm$^2$ (Calculated) Area of coverage-3 × 3 feet | Average radiant power 2.5 W, Irradiance-233 mW/cm$^2$ (Calculated) Area of coverage-3 × 3 feet |
|---|---|---|---|---|---|
| A. Very strong: severe flashblindness with afterimages, startle, disorientation, vertigo, occasional vomiting. | 2.6 mW/cm$^2$, MPE for a single exposure | 107 hours | 98 hours | 3.5 sec | Rapid* |
| B. Strong: strong flashblindness with afterimages, startle, disorientation, vertigo | 1 mW/cm$^2$ | 2.3 hours | 2 hours | Rapid* | Rapid* |
| C. Moderate to strong: strong flashblindness with afterimages, disorientation, startle | 0.5 mW/cm$^2$ | 8 min | 8 min | Rapid* | Rapid* |
| D. Moderate: flashblindness with afterimages, disorientation, occasional startle | 0.1 mW/cm$^2$ | Rapid* | Rapid* | Rapid* | Rapid* |
| E. Weak: strong glare, flashblindness, occasional afterimages | 0.01 mW/cm$^2$ | Rapid* | Rapid* | Rapid* | Rapid* |

Rapid* = <1 sec

Parameters used during the testing and calculations:

19 LED module: $\tau$=0.015 sec; F=9 Hz; d=0.135. Testing distance 6 feet.

37 LED module: $\tau$=0.011 sec; F=10 Hz; d=0.11. Testing distance 6 feet.

Columns (from left to right) in the table represent:

Column1 lists the varying incapacitating physiological and psychological effects produced due the visual impairment of bright flashing light (A, B, C, D, and E). The effects are classified in accordance to the diagram of FIG. X which is based on broad range of experimental data (see reference E). Effects are listed in the order from the strongest, A, that are caused at the irradiance levels of MPE and progressively down to the weaker introduced at lower levels of irradiance, B, C, D, and E.

Figure 5:
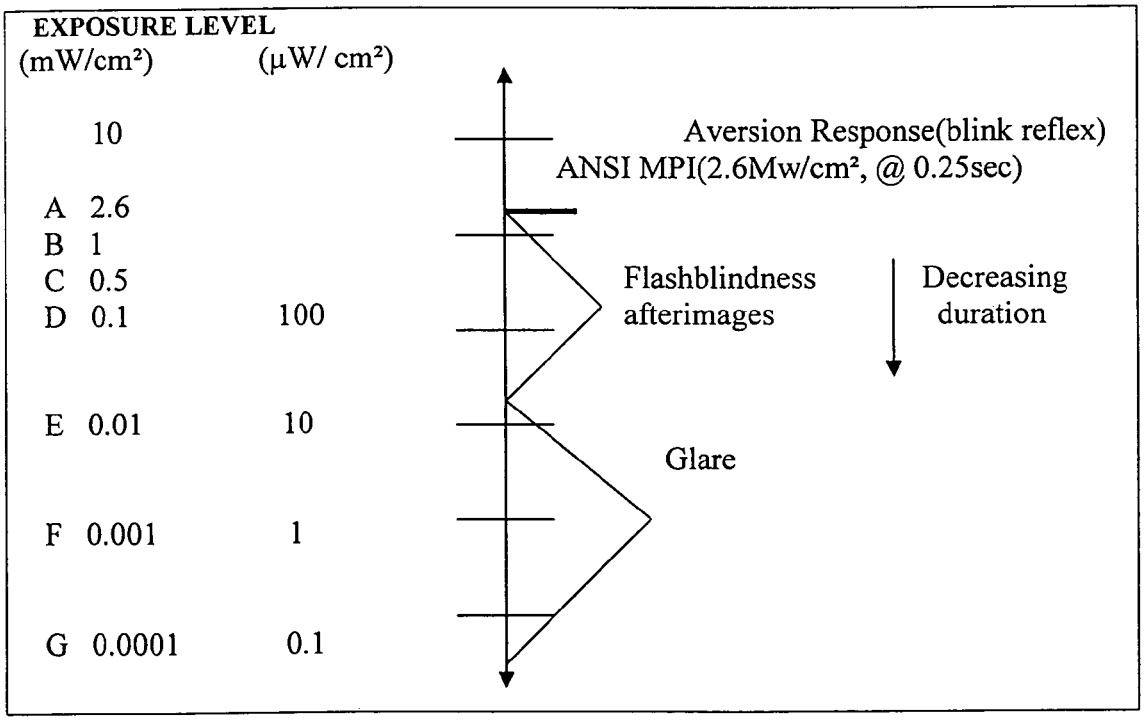
FIG. 5 shows the different levels of physiological effects that are produced from visual impairment induced by varies levels of irradiance based on a single exposure of 0.25 seconds (aversion time) from which MPE is 2.6 miliwatt/square cm as described in reference 2.

Column 2 shows the irradiance levels of a single exposure of 0.25 sec, which introduce the respective effects according the diagram in FIG. 5.

Column 3 and 4 shows the calculated time necessary to produce different levels of incapacitating effects with two different LED array configurations that were fabricated and tested. These prototypes were operated in temporal pulsed mode. The parameters of the pulse stated in the table and below the table was actually measured. The measured irradiance produced by the pulse was considered equal to the MPE, and the number of pulses that produces incapacitating effect at this level (highest permissible irradiance level) was calculated using Formula 3. Formulas 4, and 5 were used to calculate the number of pulses, which will produce effects of lower strength. The time was calculated by dividing the number of pulses by the flash frequency.

Columns 5 and 6 present the calculated incapacitating time of two of many possible devices based on the 37LED array similar to the presented in the column 4, but operating in the multidirectional strobe mode. The parameters of the device provide rapid incapacitating time and produce the strongest level of visual impairment. The only difference between them in the design is the observed aperture-6" in one device and 4" in the second one. The other parameters used in the calculations are:

Operating distance-6 feet; beam divergency-5°; irradiance-233 mW/cm$^2$ (calculated from the experimental date for the divergence angle of 25°; spot diameter at working distance-0.524 feet; simultaneously covered area-3×3 feet with 36 flashpoints; $\tau$=0.004 sec; F=7 Hz; d=0.028.

Note, that in the multidirectional strobe arrangement the exposure time related to the flashing frequency as 1/F times the number of flashpoints.

Referring to Table 1 it is first assumed that for a practical apparatus and method of incapacitation, the effect must be produced quickly, giving the target insufficient time to evade the flashing (whether in by pattern, aimed or held steady). Consequently only those entries in the table marked "rapid" are regarded as effective for incapacitation. It is appreciated that the columns 2, 3, 4, and 5 are constructed with reference to selected values for the variables, and that other selected combination of values would possibly extend the range of each value. To the extent understood from Table 1, using an array of at least about 19 LEDs incapacitation can be achieved with an aperture at exit of about 4.6 in., incapacitation can be achieved with an irradiance of at least about 4.9 mW/cm$^2$. As the aperture is closed as in column 5 to 5° and irradiance is increased to about 233 mW/cm$^2$ a considerably more severe level of incapacitation occurs. Applying the variables incapacitation can be made to occur in a method and apparatus as follows:

To reach a minimum irradiance of 1/260 of the MPE to cause "rapid" incapacitation divide formula (2) by 260.

Both projected designs are feasible. They require only the beam concentration in the smaller angle. Such nonimaging beamformers for LED arrays applications were already computed down to divergence angles of 2°. A variety of alternative designs are possible. They depend on the entry parameters, which are F, the required area of coverage, and the operating distance.

The LED array could operate in the continuous and pulsed mode. In the continuous mode the light flashing frequency is provided by the predetermined spatial movement of the actuators. In the pulsed mode the flashing frequency is provided by the synchronous movement of the actuators and electronic control of the LEDs light pulses. The pulse mode is preferable because the LED could provide few times higher pulse power, compare to the continuous mode.

A simple range finder, or radiometer similar to one used in the photo cameras to determine the exposure time could be utilized to adjust the parameters of the device, such as pulse duration, frequency and power, dependently at the operational distance, in order to provide safe operation below MPE.

REFERENCES

The content of the following references is incorporated by reference into this description:

1. ANSI Z136.6-2000, American National Standard for Safe Use of Lasers, Outdoor Lasers, New York: The Laser Institute of America, 2000.
2. R. J. Rockwell, Jr., W. J. Ertle, C. E. Moss, "Safety Recommendations of Laser Pointers," Laser-Resources, www.laser-resources.net/pointer-safety.htm, accessed Apr. 15, 2003.

Although the invention has been described with respect to various embodiments, they are not intended to be exhaustive. Many modifications and variations are possible in light of the above teaching without departing from the scope of the claims set out below. It is intended that the invention is to be limited only to the full scope and coverage of the claims as permitted under the Patent Law.

What is claimed is:

1. An apparatus for causing incapacitation comprising;

a light emitting device in which a beam of light is produced;

a spatial scanning element operative to cause the beam to be directed at each of a sequence of directions defining flash points in a predetermined pattern over an area defining a scanned area;

a flash control element operative to cause the light emitting device to flash at a selected rate;

wherein the spatial scanning element operates at a predetermined rate and the flash control element causes flashing at a predetermined rate wherein the relationship that defines the sequence of temporal flashing and spatial scanning within the pattern is given by:

$$\text{number of flashpoints per flash} = \frac{A \times C}{B};$$

where:

A=scan rate, the time for spatial scan of the entire pattern in cycles/unit time;

B=flash rate, the time in flashes/unit time; and

C=number of positions or flash points in the pattern; and the values of A, B and C as applied must result in the number of flashpoints per flash being a whole number;

wherein flashes may occur once or a multiple of times at each flash point per scan or may skip one or more flash points per scan.

2. The apparatus of claim 1 wherein the light emitting device comprises an array of light emitting elements.

3. The apparatus of claim 1 wherein the scan rate and flash rate are selected to have one or more flashes at each flash point in a randomized varying sequence.

4. The apparatus of claim 1 wherein the pattern is repetitive.

5. The apparatus of claim 1 wherein the relationship of the scan rate to the flash rate may be;

a) equal;

b) scan rate greater than flash rate; or c) flash rate greater than scan rate.

6. The apparatus of claim 1 wherein the scan rate and flash rate are selected to have one or more flashes at each flash point in an ordered sequence.

7. The apparatus of claim 1 wherein flash must occur once or a multiple of times at each flash point.

8. An apparatus for causing incapacitation comprising;

an array of light emitting elements;

a beam former in front of the array to cause light from the array to pass through the beam former as a beam;

a spatial scanning element operative to cause the beam to be directed at each of a sequence of directions in a predetermined pattern over an area defining a scanned area;

a flash control element operative to cause the light emitting elements to flash at a selected rate at each of said directions;

wherein the spatial scanning element operates at a predetermined rate and the flash control element causes flashing at a predetermined rate;

wherein the relationship that defines the sequence of temporal flashing and spatial scanning within the pattern is given by:

$$\text{number of flashpoints per flash} = \frac{A \times C}{B};$$

where:

A=scan rate, the time for spatial scan of the entire pattern in cycles/unit time;

B=flash rate, the time in flashes/unit time; and

C=number of positions or flash points in the pattern; and the values of A, B and C as applied must result in the number of flashpoints per flash being a whole number;

wherein flashes may occur once or a multiple of times at each flash point per scan or may skip one or more flash points per scan.

9. The apparatus of claim 8 wherein the light emitting elements are LEDs.

10. The apparatus of claim 8 wherein the light emitting elements are laser light sources.

11. The apparatus of claim 8 wherein the light emitting elements are an LED cluster.

12. The apparatus of claim 8 wherein the light emitting elements comprise a first group emitting green light and a second group emitting cyan light.

13. The apparatus of claim 8 wherein the flash control apparatus and the scanning elements are synchronized to cause a flash rate at each point of illumination in the scanned area by each light emitting element of 7–15 Hz.

14. The apparatus of claim 8 further comprising a beam former positioned in front of the array.

15. The apparatus of claim 8 wherein each flash is defined by a pulse duration, and has an optical power and the pulse rate, optical power and flash rate are selected so as to provide irradiance levels in the range from about $1/260^{th}$ of the MPE to the MPE over the scanned area at a particular range.

16. The apparatus of claim 9 wherein the LEDs comprise a first group emitting green light and a second group emitting cyan light.

17. The apparatus of claim 16 wherein the flash control apparatus and the scanning elements are synchronized to cause a flash rate at each point of illumination in the scanned area by each light emitting element of 7–15 Hz.

18. The apparatus of claim 17 wherein the emitted light flashes do not exceed the MPE.

19. The apparatus of claim 17 wherein the scanning element moves the beam in a selected vertical scan and in a selected horizontal scan.

20. A method for visual incapacitation of a person or other animal comprising;

providing an array of light emitting elements;

forming the light from the array of light emitting elements into a beam;

moving the beam in a predetermined pattern over an area defining a spatially scanned area;

temporally flashing each light emitting element at a selected rates;

synchronizing the scanning and flashing wherein the spatial scanning operates at a predetermined rate and the flashing operates at a predetermined rate;

wherein the relationship that defines the sequence of temporal flashing and spatial scanning within the pattern is given by:

$$\text{number of flashpoints per flash} = \frac{A \times C}{B};$$

where:

A=scan rate, the time for spatial scan of the entire pattern in cycles/unit time;

B=flash rate, the time in flashes/unit time; and

C=number of positions or flash points in the pattern; and the values of A, B and C as applied must result in the number of flashpoints per flash being a whole number;

wherein flashes may occur once or a multiple of times at each flash point per scan or may skip one or more flash points per scan.

21. The method of claim 20 further comprising synchronizing the scanning and the flashing to cause a flash rate at each point of illumination in the scanned area by each light emitting element of 7–15 Hz.

22. The method of claim 21 wherein the light emitting elements are LEDs comprising a first group of LEDs emitting green light and a second group of LEDs emitting cyan light.

23. A disabling device comprising an LED array having simultaneous multidirectional and temporal strobe.

24. The device of claim 23 further wherein the LEDs of the array are multicolor.

25. The device of claim 24 wherein the multicolors comprise green and cyan.

26. The device of claim 25 wherein the multicolors consist of green and cyan.

27. A method of causing incapacitation comprising;

providing a flashing light source having an irradiance level according to;

$$MPE\text{: } E_{pulses} = \frac{1.8 \times \tau^{0.75} \times C_E \times n^{-0.25} \times F}{0.775 \times d} \frac{\text{mW}}{\text{cm}^2}.$$

28. The method of claim 27 further wherein the flashing occurs over a number of pulses as given by;

$$n = \left( \frac{1.8 \times \tau^{0.75} \times C_E \times F}{0.775 \times d} \times \frac{1}{A \times MPE\text{: } E_{pulses}} \right)^4;$$

thereby causing the light source to flash over a period of time sufficient to cause incapacitation.

29. The apparatus of claim 8 wherein the spatial scanning element operates at a predetermined rate and the flash control element causes flashing at a predetermined rate.

30. The apparatus of claim 8 wherein the scan rate and flash rate are selected to have one or more flashes at each flash point in a randomized varying sequence.

31. The apparatus of claim 8 wherein the pattern is repetitive.

32. The apparatus of claim 8 wherein the relationship of the scan rate to the flash rate may be;

a) equal;

b) scan rate greater than flash rate; or c) flash rate greater than scan rate.

33. The apparatus of claim 8 wherein the scan rate and flash rate are selected to have one or more flashes at each flash point in an ordered sequence.

34. The apparatus of claim 8 wherein the scan rate and flash rate are selected to have one or more flashes at each flash point in a randomized repeating sequence.

35. The apparatus of claim 8 wherein flash must occur once or a multiple of times at each flash point.

36. The apparatus of claim 8 wherein the scan rate and flash rate are selected to have one or more flashes at each flash point in a varying ordered sequence.

* * * * *